US008089436B1

(12) United States Patent
Werner

(10) Patent No.: US 8,089,436 B1
(45) Date of Patent: Jan. 3, 2012

(54) IMAGE STABILITY IN LIQUID CRYSTAL DISPLAYS

(75) Inventor: Ralph A. Werner, Burnsville, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 1086 days.

(21) Appl. No.: 11/708,871

(22) Filed: Feb. 21, 2007

(51) Int. Cl.
*G09G 3/36* (2006.01)

(52) U.S. Cl. ..... 345/87

(58) Field of Classification Search ..... 345/102, 345/204, 87, 88, 89
See application file for complete search history.

(56) References Cited

U.S. PATENT DOCUMENTS

| | | | | |
|---|---|---|---|---|
| 5,844,540 | A * | 12/1998 | Terasaki | 345/102 |
| 6,392,620 | B1 * | 5/2002 | Mizutani et al. | 345/88 |
| 6,452,582 | B1 * | 9/2002 | Rolston | 345/102 |
| 6,693,619 | B1 * | 2/2004 | Miura et al. | 345/102 |
| 6,933,917 | B2 | 8/2005 | Chung et al. | |
| 6,982,775 | B2 | 1/2006 | Lee et al. | |
| 7,002,539 | B2 * | 2/2006 | Shimada | 345/88 |
| 7,079,097 | B2 | 7/2006 | Lee | |
| 7,248,244 | B2 * | 7/2007 | Akiyama | 345/102 |
| 2002/0044116 | A1 * | 4/2002 | Tagawa et al. | 345/87 |
| 2003/0117364 | A1 * | 6/2003 | Miyake | 345/102 |
| 2005/0259064 | A1 * | 11/2005 | Sugino et al. | 345/102 |
| 2006/0284825 | A1 * | 12/2006 | Teranishi | 345/102 |

OTHER PUBLICATIONS

What is TFT LCD TV and LCD Monitor Panel?, NETBORED.com, http://wwvv.netbored.com/classroom/what_is_ tft_lcd.htm.

* cited by examiner

*Primary Examiner* — Richard Hjerpe
*Assistant Examiner* — Carolyn R Edwards
(74) *Attorney, Agent, or Firm* — Brooks, Cameron & Huebsch PLLC

(57) ABSTRACT

One method of controlling a backlight for image stability in a liquid crystal display (LCD) device including providing a sequence of display image information to a plurality of pixel elements of the LCD device, turning the backlight of the LCD device to an off state during a first portion of a refresh cycle of the pixel elements, and turning the backlight of the LCD device to an on state during a second portion of the refresh cycle of the pixel elements to display a display image based on a first display image information item from the sequence of display image information on the LCD device.

22 Claims, 4 Drawing Sheets

IMAGE STABILITY IN LIQUID CRYSTAL DISPLAYS

FIELD OF THE DISCLOSURE

The present disclosure generally relates to displaying images on display devices, such as Liquid Crystal Displays (LCDs) devices. And, in particular, the present disclosure relates to the display of images without flicker on LCD devices.

BACKGROUND

Liquid Crystal Display (LCD) devices are used to display images, including symbols, such as text characters and/or pictures. LCD devices have a display screen with a number of image elements (or pixel elements) that are refreshed at a refresh rate generally above 25 Hz, with values being about 60 Hz in many instances. The display images on the LCD devices may be monochromatic or color.

LCD devices can include a backlight element that provides light through an array of liquid crystal elements that form each pixel of the LCD device. The liquid crystal elements provide the color and transmittance of light (i.e., the luminance) at the location of the pixel.

A succession of image frames can be used to display an image on the LCD device. The light of the successive frames displayed on the LCD device is integrated by the human eye. If the number of displayed image frames per second (i.e., the refresh rate) is sufficiently high, images being displayed in a continuous way can create the illusion of motion. One issue with the use of some LCD devices, however, is that of luminance flashes or luminance jumps as the displayed image frame changes. These flashes and/or jumps are also referred to as flicker.

Flashes and/or jumps on LCDs can be due to differences between the rise and fall rates of pixel luminance changes (i.e., the turn ON and turn OFF times of the LCD pixel elements), for example, when large numbers of pixels are simultaneously being changed. For example, flashes on an LCD can occur when a high contrast image is shifted (or scrolled) one pixel up, down, left, and/or right on the screen. The rise and fall rates of LCD pixel luminance changes can also be affected by the initial and final color state (i.e., image content), LCD type, manufacturing process variation, temperature variation, and viewing angle. Human eye sensitivity to the luminance jumps on LCDs may also vary with each individual.

A scrolling image, such as a sonar waterfall, is an example where flashes and/or jumps can occur with each scroll step of the image. When the image is scrolled, a large number of adjacent pixel elements may be changing from light to dark at the same time that a large number of adjacent pixel elements are changing from dark to light. Differing rise and fall rates (i.e., ON/OFF times of the adjacent pixel elements) during these complementary pixel transitions may result in flashes and/or jumps in the LCD display.

SUMMARY

Embodiments of the present disclosure provide various methods, apparatuses, and systems for providing image stability in a liquid crystal display (LCD) device. Embodiments provided herein include controlling a backlight of the LCD device so as to provide image stability in the LCD device. As used herein, image stability can include producing stable images in the LCD device that have reduced, or are free of, luminance flashes and/or jumps (i.e., flicker).

In various embodiments, the backlight of the LCD device can be cycled between an off state and an on state for refresh cycles of a plurality of pixel elements of the LCD device. In one embodiment, the cycling of the backlight between an off state and an on state can occur for each refresh cycle of the pixel elements of the LCD device.

As used herein, an "off state" of the backlight includes the situation where the backlight is turned off so as to provide minimal, or no, luminance from the backlight. As used herein, an "on state" of the backlight includes the situation where the backlight is turned on so as to provide luminance from the backlight.

In various embodiments, changes to the plurality of pixels of the LCD display can take place while the backlight is in the off state. In other words, changes to the state of one or more of the pixels (e.g., turning off, turning on, changes to the luminance state or level and/or color) can take place while the backlight of the LCD device is in the off state. As a result, the viewer will be less likely, or will not, see changes in or to the pixels that would have otherwise produced luminance flashes and/or jumps if the backlight of the LCD device had been on.

In addition, transitioning the backlight in this cycling manner can be used to produce an area of brightness around adjacent pixel elements that has a repeating visual pattern. The repeating visual pattern of the area of brightness can be perceived by the viewer as having a consistent luminance, even though the image provided by the pixel elements may be changing. The consistent luminance of the repeating visual pattern allows the eye of the viewer to integrate the image, changing or not, into stable images that do not flicker or show luminance jumps, among other benefits.

By way of structure, LCD devices include thin-film transistors (TFTs) in a TFT panel, a driving-circuit unit, a backlighting system, and an assembly unit (e.g., a housing), among other components. The backlighting system can include those having a variety of backlight types and sources.

Such devices can include backlit and/or sidelit displays. Light sources can include light emitting diodes (LEDs), ultra high pressure (UHP) lamps, and fluorescent lamps such as cold cathode fluorescence lamps or external electrode fluorescent lamps, among other suitable light sources.

The TFT panel can include a TFT-array substrate and a color-filter substrate, in some embodiments. The TFT-array substrate can contain the TFTs, storage capacitors, pixel electrodes, and interconnect wiring. The color-filter substrate can contain a black matrix and resin film containing color pigments or dyes (e.g., red, blue and green).

Glass substrates can be used to contain the LC material and polarizer films can be attached to the outer surfaces of the glass substrates. A set of boding pads can be provided on each end of gate- and data-signal bus-lines on which to attach LCD Driver integrated circuit chips. Electrical signals sent to bus-lines can cause the liquid crystals in the pixel elements to react by filtering out or projecting light onscreen to form the display image.

In many devices, the screen of the LCD device is completely redrawn with a new image many times a second. The time it takes for the LCD device to redraw, for example, a portion of or the entire screen can be referred to as the refresh cycle of the LCD device. The faster the refresh cycle, the faster the LCD device redraws the frame. Refresh cycles can have values to provide refresh rates for the LCD device of, for example, 60 Hz (i.e. 60 frames displayed every second) and faster (e.g., 85 and 120 Hz).

In various embodiments, the present disclosure provides for first display image information (i.e., data used to produce a first image) to be provided to a plurality of pixel elements of the LCD device at a first time. The LCD device can provide the first display image information to the pixel elements during a refresh cycle of the LCD device.

During a first portion of the refresh cycle, the backlight of the LCD device can be turned, or set, to the off state. In other words, in some embodiments, it is during this first portion of each refresh cycle when the backlight is in the off state that the pixel elements, to provide the image on the LCD device, are changing or transitioning from one state to the next for providing the first image.

Once the pixel elements have completed their change, the backlight can be turned to the on state to provide luminance to the pixel elements to provide the first image on the LCD device. In various embodiments, turning the backlight of the LCD device to the on state can occur during a second portion of the refresh cycle of the pixel elements. In some embodiments, turning the backlight of the LCD device to an on state for the second portion occurs before an ending of the refresh cycle for the plurality of pixel elements.

As appreciated, "portions" of the refresh cycle do not necessarily have to be equal. For example, the timing of the transition from the off state to the on state for the backlight can be dependent upon the response time of the one or more pixels to rise to the on state (i.e., the pixel turn on time) and to fall from the off state (i.e., the pixel turn off time), which ever is longer. In various embodiments, because the backlight can be in the off state during the first portion of the refresh cycle, the differences in timing of the changing pixels can be less noticeable or made imperceptible to a viewer.

During the second portion of the refresh cycle a display image based on the first display image information can be provided on the LCD device. The backlight can remain in the on state until the start of the next sequential refresh cycle. At the start of next sequential refresh cycle, the backlight can be turned or set to the off state where it can remain in the off state for the duration of the first portion of the refresh cycle.

The backlight can be turned to the on state as the pixel elements complete their transition. The cycling of the backlight between the off state and the on state can continue for one or more of the refresh cycles, including for each of the refresh cycles.

In various embodiments, turning the backlight to the off state during the first portion includes turning the backlight to the off state during a first portion (e.g., first half) of the refresh cycle. The backlight can be turned back to the on state during a second portion (e.g., a second half) of the refresh cycle.

In some embodiments, the first and second portions can each be fifty percent (50%). As will be appreciated, other values approximate to fifty percent (50%) could also be used for the first and second portions.

In some embodiments, the first portion of the refresh cycle can include a number of different percentages of the duration of the refresh cycle (i.e., not necessarily fifty percent (50%)). For example, the first portion of the refresh cycle can have a value of twenty five percent (25%) to fifty percent (50%) of the duration of the refresh cycle.

Alternatively, the first portion of the refresh cycle can have a value of ten percent (10%) to fifty percent (50%) of the duration of the refresh cycle. Other ranges include, but are not limited to, 5% to 40%, 5% to 50%, 10% to 40%, 20% to 40%, 20% to 50%, and 25% to 40%, among others.

Regardless of the percent of duration, turning the backlight to the off state can be synchronized with a start of the refresh cycle. So, for example, the backlight can be synchronized to be in the off state at the start, or beginning, of each of the refresh cycles. In such embodiments, the backlight can be kept in the off state during the first portion of the refresh cycle for at, least as long as one of a pixel turn on time and a pixel turn off time, which ever is longer, of the first display image.

In various embodiments, turning off the backlight can be synchronized with a change in the first display image. For example, first display image information can be provided to the plurality of pixel elements with the backlight in the off state during the beginning of a first refresh cycle. The display image can be updated in a subsequent refresh cycle, where the updating to the pixel elements occurs with the backlight in the off state during the first portion of the refresh cycle.

So, for example, when second display image information is provided to the plurality of pixel elements at a second time to replace the first display image information, it can be done with the backlight in the off state during a refresh cycle. Once replaced, the backlight can be turned, or set, to the on state to display the second display image. The cycling of the backlight between the off state and the on state can continue for the refresh cycles for the display of one or more images on the LCD device.

In displaying the second image, however, a situation can arise in which adjacent pixel elements of the pixel matrix (e.g., a first pixel and a second pixel) may change their state from on to off, or from off to on. This transition of adjacent pixel elements, or group of pixel elements, can create luminance flashes or luminance jumps (i.e., flicker) as the displayed image frame changes. This is possible, for example, when the adjacent pixel elements in a high contrast situation undergo a change from light to dark at the same time other groups of adjacent pixels are changing from dark to light.

This can be due to differences between the rise and fall rates of pixel luminance changes (i.e., the response time of the pixel elements to turn on and to turn off). For example, flashes on an LCD device can occur when a high contrast image is shifted (or scrolled) one pixel up, down, left, and/or right on the screen. The rise and fall rates of LCD pixel luminance changes can be affected by the initial and final color state (i.e., image content), LCD type, manufacturing process variation, temperature variation, and viewing angle, as discussed herein. Human eye sensitivity to the luminance jumps on LCDs may also vary with each individual.

A scrolling image, such as a sonar waterfall, is an example where flashes and/or jumps can occur with each scroll step of the image. When the image is scrolled, a large number of adjacent pixel elements may be changing from light to dark at the same time that a large number of adjacent pixel elements are changing from dark to light. Differing rise and fall rates (i.e., ON/OFF times of the adjacent pixel elements) during these complementary pixel transitions may result in flashes and/or jumps in the LCD display.

In various embodiments of the disclosure, image stability can be provided for the images by having the backlight in the off state during the portion of the refresh cycle when the pixels are changing from dark to light or visa versa (e.g., when the image is scrolling). In various embodiments, the backlight in the off state minimizes, or prevents, the viewer from observing the transitions in the pixels that would otherwise create luminance flashes and/or jumps as the image changes, shifts, or scrolls.

In addition, cycling the backlight can produce a repeating sequence of visual pulses having a similar average luminance per refresh cycle for adjacent pixel elements of the first display image and the second display image. In various embodiments, cycling the backlight in this manner produces an area of brightness around adjacent pixel elements that provide the repeating visual pattern.

The repeating visual pattern of the area of brightness is perceived by the viewer as having a consistent luminance. The consistent luminance of the repeating visual pattern allows the eye of the viewer to integrate the image, changing or not, into stable images that do not flicker or show luminance jumps, among other benefits.

In some embodiments, this consistent repeating pattern of luminance produced in the area of brightness can have a repetitive wave shape that is similar for both the first image and the second image. In various embodiments, the consistent repeating pattern of luminance can have a consistent luminance, and even have a constant luminance.

For example, adjacent pixel elements can produce repeating visual pulses per refresh cycle that can have a similar average luminance. So, the observer will see the repeating sequence of pulses when the image is stable and when the image is moving and the average luminance per refresh cycle does not change and so no flicker is observed.

In addition, the timing of the off state and the on state of the backlight can produce an area of brightness with a consistent repeating pattern of consistent and/or constant luminance for each refresh cycle. The viewer sees this repeating pattern for the area of brightness as having the consistent and/or constant luminance and not luminance flashes or jumps as the displayed image frame changes during the refresh cycle. As a result, changes to the displayed image on the LCD can be seen by the viewer without luminance flashes or jumps as the displayed image frame changes during the refresh cycle.

The functionality discussed herein can be accomplished, for example, by logic circuitry and/or by having a processor and memory within or associated with the LCD device. For example, embodiments of the present disclosure can include a backlight control device for use in the LCD display. The backlight control device can be used to cycle the LCD device between the off state and the on state for the refresh cycles, as discussed herein.

In some embodiments, the LCD device can include an LCD panel having a plurality of pixel elements to provide display images, a backlight for projecting light to the LCD panel, and a backlight control device. The LCD panel can include a display area having the plurality of pixel elements for displaying images, and a periphery circuit area.

The backlight control device can include a system driver, a power supply device, and the backlight source control circuit. The power supply device provides a voltage to the system driver.

In the various embodiments, the backlight source control circuit can provide a backlight driving signal, a data signal, and a control signal to the system driver. The system driver is positioned on the periphery circuit area for driving the LCD panel to display images on the display area according to the backlight driving signal, the data signal and the control signal.

The backlight can be a light emitting diode (LED), ultra high pressure (UHP) lamps, and fluorescent lamps such as cold cathode fluorescence lamps or external electrode fluorescent lamps. The system driver can be an integrated circuit (IC).

As discussed herein, the backlight source control circuit can operate to cycle the backlight in a synchronized fashion with the refresh cycles between the off state and the on state. For example, the backlight source control circuit can cycle the backlight source between one of an on state and an off state for each refresh cycle of the pixel elements that provides the display image, as discussed herein. In various embodiments, the system driver can drive the pixels of the LCD panel to display images as the backlight source control circuit provides the backlight driving signal to cycle the backlight source between the off state and the on state for the portions of the refresh cycles, as described herein.

For example, the backlight source control circuit can turn the backlight source to the off state during a first portion of each refresh cycle of the plurality of the pixel elements and to the on state during a second portion of each refresh cycle of the plurality of the pixel elements. In various embodiments, the backlight source control circuit synchronizes turning the backlight source to the off state with a start of each refresh cycle. The backlight source control circuit can also synchronize turning the backlight source to the off state with a change in the first display image.

In some embodiments, the backlight source control circuit can also keep the backlight source in the off state for at least as long as one of a pixel turn on time and a pixel turn off time, which ever is longer, for a display image. In various embodiments, the backlight source control circuit can also keep the backlight source in the off state until the pixel elements have been updated with a subsequent (e.g., a second) display image. The backlight source control circuit can switch the backlight source to the on state to display the subsequent display image.

Embodiments of the present disclosure can also provide several advantages over previous approaches to dealing with luminance flashes and jumps. For example, in some embodiments of the present disclosure calibration, or recalibration, of response times for the on and off states of the pixels may not be needed.

This can be an advantage because response times for the on and off states are dependent on a number of factors that can change with the use of the LCD device.

These include, but are not limited to, changes in the operating temperature of the LCD device and the configuration of each manufactures LCD device. In addition, embodiments of the present disclosure for dealing with luminance flashes and jumps may not be dependent upon a particular viewing angle of the LCD device, which can be an advantage over previous approaches to address luminance flashes and jumps.

These and other advantages of the various embodiments of the present disclosure will become evident to those skilled in the art upon reading the disclosure.

DETAILED DESCRIPTION

Figure 1A:
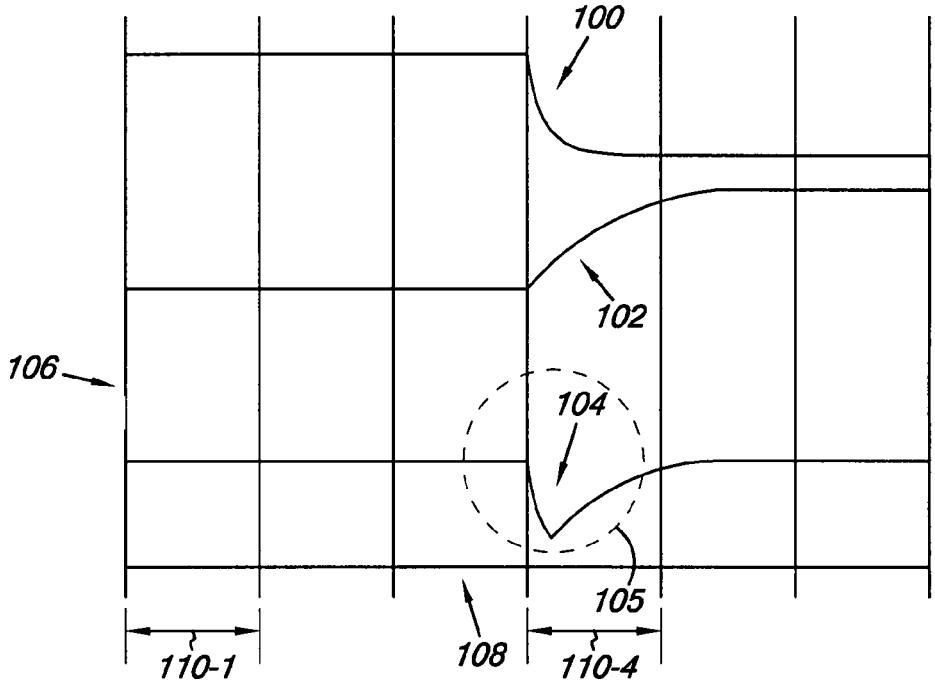
FIG. 1A is an illustration of a luminance flash or jump produced in an LCD device.

The present disclosure includes a number of method, apparatus, and system embodiments for providing image stability in a liquid crystal display (LCD) device. Embodiments of the present disclosure will now be described in relation to the accompanying drawings, which will at least assist in illustrating various features of the various embodiments.

The figures herein follow a numbering convention in Which the first digit or digits correspond to the drawing figure number and the remaining digits identify an element or component in the drawing. Similar elements or components between different figures may be identified by the use of similar digits.

For example, 110 may reference element "10" in FIG. 1, and a similar element may be referenced as 210 in FIG. 2. As will be appreciated, elements shown in the various embodiments herein can be added, exchanged, and/or eliminated so as to provide a number of additional embodiments. In addition, discussion of features and/or attributes for an element with respect to one Figure can also apply to the element shown in one or more additional Figures.

FIG. 1A is an illustration of a luminance flash or jump produced in an LCD device. As illustrated, there is shown a pixel falling luminance 100, a pixel rising luminance 102, and total luminance 104 including the sum of falling luminance 100 and rising luminance 102, with luminance on the vertical axis 106 and time on the horizontal axis 108.

The pixel transitions occur periodically at the refresh time corresponding to a number of refresh rates 110 (two refresh cycles are indicated with a first cycle being labeled 110-1 and a fourth refresh cycle being labeled 110-4), or refresh cycle, of the display, for example 60 Hz or 16.6 ms. The total luminance 104 shows a dark flash 105 resulting from a luminance dip caused by the rate of the pixel falling luminance 100 being faster than the rate of the pixel rising luminance 102 on refresh cycle 110-4.

Figure 1B:
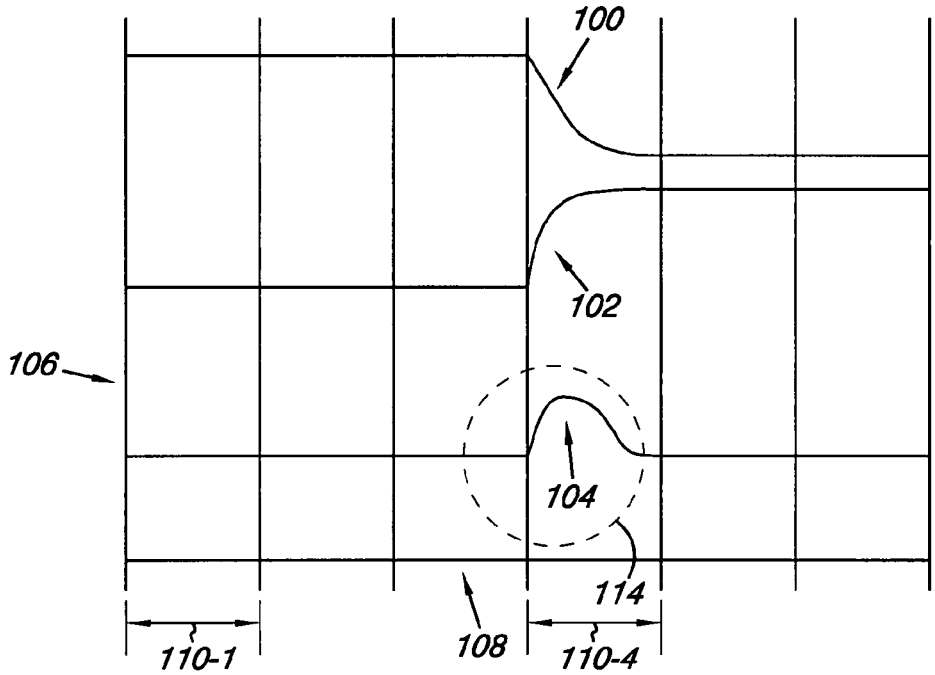
FIG. 1B is an illustration of another type of luminance flash or jump produced in an LCD device.

FIG. 1B is an illustration of another type of luminance flash or jump produced in an LCD device. In FIG. 1B, luminance is provided on the vertical axis 106, time is provided on the horizontal axis 108 and the refresh rate is provided as 110 (i.e., each cycle 110-1 and 110-4 having the same refresh rate).

As illustrated, a luminance white flash 114 is created during refresh cycle 110-4 when the total luminance 104 exceeds the average luminance and lasting until the pixel falling luminance 100 and the pixel rising luminance 102 reach their final state. In this case, the pixel rising luminance 102 is faster than the pixel falling luminance 100 resulting in a total luminance 104 that exceeds the average luminance during the pixel transitions.

In practice, the luminance flash 105 and 114 are only discernible, for example, to a viewer if large numbers of pixel elements perform similar pixel transitions simultaneously. When large numbers of pixel elements perform these transitions simultaneously, the actual luminance flash is the sum of individual pixel luminance flashes.

For example, in some applications, information can be added to the viewable image from the top of the LCD screen being viewed. For instance, in navigation, as an individual moves forward, the new information about the area being encountered can be added to the top of the screen.

In such instances, this added information moves all of the preceding rows of pixel images down the screen to the next row of physical pixels such that the information at the bottom of the screen is being scrolled off the bottom of the screen. This type of application can appear as a waterfall or cascade of information moving down the screen.

An observer expects the luminance of such an image to be consistent from refresh cycle to refresh cycle because most of the average luminance is changing very slowly (e.g., only one row of pixels is added and one row of pixels are removed each time the image is updated and the image may not be updated on every refresh cycle). However in such applications, when the actual rise and fall times are different, this cascading, when refreshed, can cause flashing that can be very distracting and annoying. The luminance variation or flashing can vary depending upon the initial and final state of the pixel transitions.

Figure 2A:
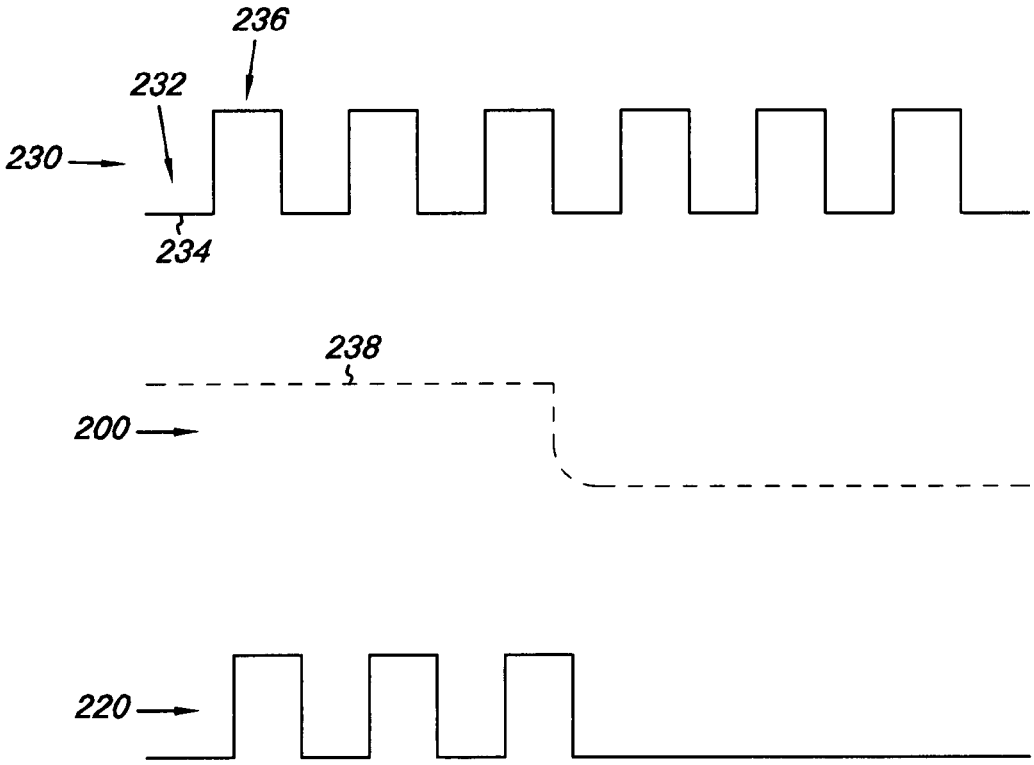
FIG. 2A provides an illustration of the effect on the luminance of a pixel when the backlight is turned off and on during each refresh cycle.

FIG. 2A provides an illustration of the effect on the luminance of a pixel when the backlight is turned off and on during each refresh cycle. FIG. 2A provides three luminance values versus time graphs. The top graph is the backlight 230, the middle graph is the pixel 200, and the bottom graph is the combination 220 of the backlight and pixel (e.g., an AND logical relationship is used to create the combination in this graphical example).

Figure 2B:
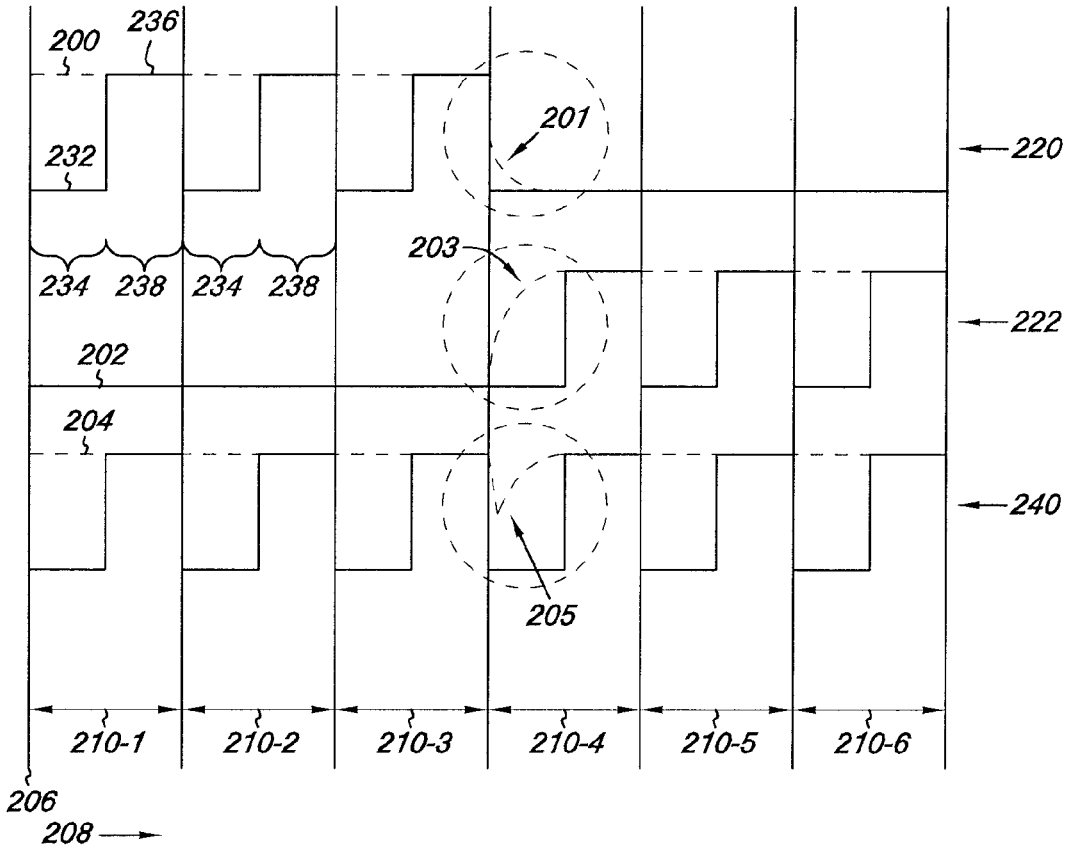
FIG. 2B is an illustration of cycling a backlight between an off state and an on state for each refresh cycle to produce an area of brightness having consistent luminance.

In the embodiment illustrated in FIG. 2A, backlight 230 is turned off (e.g., state 232) and on (e.g., state 236) during each refresh cycle (e.g., refresh cycles 210-1 through 210-6 in FIG. 2B). When the backlight 230 is off 232, the resultant pixel luminance 220 appears to be off even though the pixel 200 is actually on. When the backlight 230 is on 236 and the pixel 200 is on (as is the case in the first half of FIG. 2A) then the pixel appears to be on (as is the case in the first half of FIG. 2A on graph 220). This is due to the backlight providing luminance to the pixel. In such embodiments, when the pixel 200 is off (as is the case in the second half of FIG. 2A), then the pixel 220 appears to be off regardless of whether the backlight is providing luminance to the pixel (as illustrated in the second half of graph 220).

FIG. 2B provides an illustration of cycling a backlight between an off state and an on state for each refresh cycle to produce an area of brightness having consistent luminance. In the example shown in FIG. 2B, graphs of two pixels (as viewed by a viewer) based upon the methodology of FIG. 2A are presented along with a combined graph showing the transition of information between the first pixel and the second pixel as viewed by a viewer.

In the top graph, representing first pixel 220, a pixel state is represented by a horizontal dashed line 200 spanning from the left side of the graph to the middle of the graph (and partially obscured by the solid line representing the viewable luminance of the pixel) and transitioning downward to a second horizontal line that runs parallel with and, therefore, obscured by the solid horizontal line from the middle to the right side of the graph. The solid line 220 represents what is viewed by a viewer of the pixel as illustrated in the bottom graph in FIG. 2A.

In this graph, the first half of the graph represents an on state of the pixel coupled with a backlight turning off periodically on-off. In this embodiment, the backlight cycles off and on during different-portions 234 and 238 of the various refresh cycles 210.

In this graph, an AND logical operation produces a viewable on state 236 only when both the pixel and the backlight are on, a viewable off state when the pixel is on and the backlight is off 232, and a viewable off state when the pixel and the backlight are off (illustrated in the second half of the graph). In such a methodology, the viewable pixel does not include the transition region illustrated at time 201.

In the middle graph, representing second pixel 222, a pixel state is represented by a horizontal dashed line 202 spanning from the left side of the graph to the middle of the graph that runs parallel with and, therefore, obscured by the solid horizontal line from the left side of the graph to the middle. The solid line represents what is viewed by a viewer of the pixel. The pixel state then transitions upward from an off state to an on state in the middle of the graph at 203 to a dashed second horizontal line spanning from the middle to the right side of the graph.

In this graph, the first half of the graph represents an off state of the pixel 202 coupled with a backlight 230 turning on and off periodically. In this graph, an AND logical operation produces a viewable off state 232 when the pixel and the backlight are off, a viewable off state 232 when the pixel is on and the backlight is off, and a viewable on state 236 only when both the pixel and the backlight are on (illustrated in the second half of the graph). In such a methodology, the viewable pixel does not include the transition region illustrated at 203.

In the bottom graph, the combination of pixels 200 and 202 is illustrated by dashed line 204. The solid line 240 in the graph is the combined luminance of the pixels 220 and 222 as viewed by a viewer.

The transition 205 is the combination of transitions 201 and 203 of the first and second pixel. M is illustrated in this graph, the viewer sees a consistent repeating luminance pattern 240 at each refresh cycle 210-1, 210-2, 210-3, through 210-6, rather than any discontinuities in particular the transition 205 in cycle 210-4.

In some embodiments, the first image and second image can have luminance values between an off state and a full on state (e.g., a gray state). In such embodiments, the pixels may change between any of an off state, a full on state, a first middle state (i.e., having a value between off and full on), or a second middle state (i.e., having a different middle value than the first middle state.

In addition, an area of brightness provided by adjacent pixel elements (e.g., the luminance response or sum of the luminance of the first pixel 220 and the second pixel 222) can provide essentially the same repeating pattern of consistent luminance for the second image as was seen by the viewer for the first image. The viewer's eye can integrate these repeating luminance pulses of the repeating pattern to provide the stable image on the LCD display.

So, when adjacent pixels transition from providing to not providing luminance (or providing more luminance to less luminance in cases of gray states and the like), the overall repeating pattern of the luminance pulses does not change enough for the viewer to see a luminance flash or jump. Because, in many embodiments, the pixel turn on and turn off times are a function of the viewing angle of the observer, one benefit of such a consistent average luminance approach is that the viewer can view the screen from any suitable angle with the benefit of improved flashing characteristics.

Figure 3:
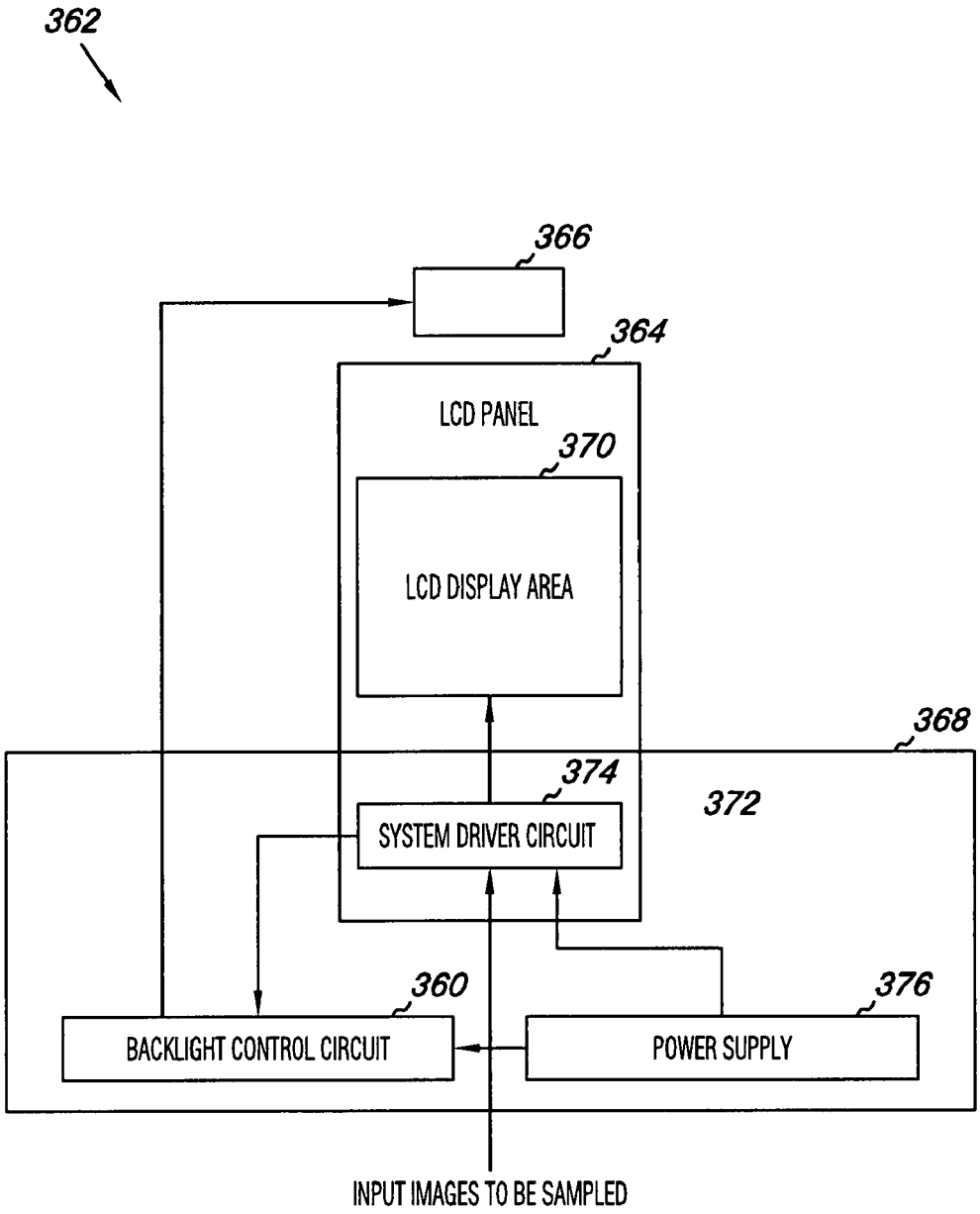
FIG. 3 is a block diagram of a backlight source control circuit according to an embodiment of the present disclosure.

FIG. 3 provides an illustration of a block diagram that includes a backlight source control circuit 360 according to an embodiment of the present disclosure. As illustrated, there is provided an LCD device 362 that includes an LCD panel 364, a backlight 366 for projecting light to the LCD panel 364, and a LCD control device 368.

The LCD panel 364 can include a display area 370 having a plurality of pixel elements for displaying images. The LCD control device 368 can include a system driver 374, a power supply device 376, and the backlight source control circuit 360. The power supply device 376 can provide voltages to the system driver 374 and the backlight control circuit 360.

In the various embodiments, the backlight source control circuit 360 can provide a backlight driving signal to the backlight 366 in synch with the refresh cycles embedded in the data and control signals sent to the system driver 374. The system driver 374 drives the LCD panel 364 to display images on the display area 370 according to the data signal and control signals provided to the LCD device 362. The backlight 366 can be a light emitting diode (LED), ultra high pressure (UHP) lamps, and fluorescent lamps such as cold cathode fluorescence lamps or external electrode fluorescent lamps. In some embodiments, the backlight source control circuit 360 and system driver 374 can be integrated circuits (ICs).

As discussed herein, the backlight source control circuit 360 can operate to cycle the backlight 366 in a synchronized fashion with the refresh cycles between the off state and the on state. For example, the backlight source control circuit can cycle the backlight source between one of an on state and an off state for each refresh cycle of the pixel elements that provides the display image, as discussed herein. In various embodiments, the system driver circuit can drive the pixels of the LCD panel to display images as the backlight source control circuit provides the backlight driving signal to cycle the backlight source between the off state and the on state for the portions of the refresh cycles, as described herein.

Although specific embodiments have been illustrated and described herein, those of ordinary skill in the art will appreciate that any arrangement calculated to achieve the same techniques can be substituted for the specific embodiments shown. This disclosure is intended to cover adaptations or variations of various embodiments of the present disclosure. It is to be understood that the above description has been made in an illustrative fashion, and not a restrictive one.

Combination of the above embodiments, and other embodiments not specifically described herein will be apparent to those of ordinary skill in the art upon reviewing the above description. The scope of the various embodiments of the present disclosure includes various other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the present disclosure require more features than are expressly recited in each claim.

Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. A method of controlling a backlight for image stability in a liquid crystal display (LCD) device, comprising:

providing a sequence of display image information to a plurality of pixel elements of the LCD device;

turning the backlight of the LCD device to an off state during a first portion of a refresh cycle of the pixel elements, where a first pixel transitions from on to off and a second pixel transitions from off to on during the first portion of the refresh cycle; and turning the backlight of the LCD device to an on state during a second portion of the refresh cycle of the pixel elements and having the backlight of the LCD device remain on during the second portion of the refresh cycle of the pixel elements to display an area of brightness associated with the first pixel and the second pixel that has a luminance that is the same as a luminance of the area of brightness associated with the first pixel and the second pixel during a second portion of an immediately prior refresh cycle based on the sequence of display image information on the LCD device.

2. The method of claim 1, where turning the backlight to the off state during the first portion includes turning the backlight to the off state during a first half of the refresh cycle, and where turning the backlight to the on state during the second portion of the refresh cycle includes turning the backlight to the on state during a second half of the refresh cycle.

3. The method of claim 2, where turning the backlight to the off state and to the on state includes turning the backlight to the off state and to the on state for each refresh cycle of the LCD device.

4. The method of claim 1, where turning the backlight to the off state during the first portion includes keeping the backlight in the off state for at least as long as one of a pixel turn on time and a pixel turn off time, which ever is longer.

5. The method of claim 1, where turning the backlight to the off state is synchronized with a start of the refresh cycle.

6. The method of claim 1, where turning the backlight to the off state includes synchronizing the turning of the backlight to the off state with a change in display image information.

7. The method of claim 6, including updating the pixel elements with updated second display image information prior to turning the backlight of the LCD device to the on state.

8. A method for providing image stability in a liquid crystal display (LCD) device, comprising:

cycling a backlight of the LCD device between one of an on state and an off state for refresh cycles of a plurality of pixel elements;

providing first display image information to the plurality of pixel elements with the backlight in the off state during a first refresh cycle and turning the backlight on for the duration of a second portion of the first refresh cycle to display the first display image with consistent luminance; and providing second display image information to the plurality of pixel elements with the backlight in the off state during a second refresh cycle and turning the backlight on for the duration of a second portion of the second refresh cycle to display the second display image with the same consistent luminance as the first display image during the second portion of the second display image during the second portion of an immediately prior second refresh cycle.

9. The method of claim 8, where cycling the backlight includes turning the backlight to the off state during a first portion of the refresh cycles and to the on state during the second portion of the refresh cycles.

10. The method of claim 8, where cycling the backlight includes synchronizing the off state with a start of each of the refresh cycles.

11. The method of claim 8, where cycling the backlight produces a repeating sequence of visual pulses having a consistent average luminance per refresh cycle for adjacent pixel elements of the first display image and the second display image.

12. A method of producing a stable image in a liquid crystal display (LCD) device, comprising:

turning a backlight of the LCD device to an off state at a beginning of each refresh cycle for a plurality of pixel elements;

changing a state of one or more of the plurality of pixel elements while the backlight of the LCD device is in the off state; and turning the backlight of the LCD device to an on state before an ending of the refresh cycle for the plurality of pixel elements and for the duration of the refresh cycle for the plurality of pixel elements to display a display image with an area of brightness associated with a first pixel and a second pixel that has a luminance that is the same as a luminance of the area of brightness associated with the first pixel and the second pixel during a second portion of an immediately prior refresh cycle based on the state of one or more of the plurality of pixel elements.

13. The method of claim 12, where turning the backlight to the on state before the ending of each of the refresh cycles produces repeating visual pulses that produce the stable image in the LCD device.

14. The method of claim 13, where repeating visual pulses for adjacent pixel elements per refresh cycle have a similar average luminance.

15. The method of claim 12, where changing the state of one or more of the plurality of pixel elements includes keeping the backlight in the off state for at least as long as one of a pixel turn on time and a pixel turn off time, which ever is longer.

16. A backlight control device for a liquid crystal display (LCD) device, comprising:

a LCD having a plurality of pixel elements to provide a first display image, where the plurality of pixel elements undergoes refresh cycles;

a backlight source for the LCD; and a backlight source control circuit in communication with the backlight source and the LCD, where the backlight source control circuit cycles the backlight source between one of an on state and an off state for each refresh cycle of the pixel elements that provide the first display image and provides first display image information to the plurality of pixel elements with the backlight source in the off state during a refresh cycle and turns the backlight source on for the duration of a second portion of the refresh cycle to display an area of brightness associated with a first pixel and a second pixel that has a luminance that is the same as a luminance of the area of brightness associated with the first pixel and the second pixel during a second portion of an immediately prior refresh cycle.

17. The backlight control device of claim 16, where the backlight source control circuit turns the backlight source to the off state during a first portion of each refresh cycle of the plurality of the pixel elements.

18. The backlight control device of claim 17, where the backlight source control circuit turns the backlight source to the on state during a second portion of each refresh cycle of the plurality of the pixel elements.

19. The backlight control device of claim 16, where the backlight source control circuit keeps the backlight source in the off state for at least as long as one of a pixel turn on time and a pixel turn off time, which ever is longer, of the first display image.

20. The backlight control device of claim 16, where the backlight source control circuit synchronizes turning the backlight source to the off state with a start of each refresh cycle.

21. The backlight control device of claim 16, where the backlight source control circuit synchronizes turning the backlight source to the off state with a change in the first display image.

22. The backlight control device of claim 16, where the backlight source control circuit keeps the backlight source in the off state until the pixel elements have been updated with a second display image.

* * * * *